United States Patent [19]

Braun

[11] 3,968,534

[45] July 13, 1976

[54] DEVICE FOR USE IN THE MANUFACTURE OF SHOES

[75] Inventor: Dieter Braun, Stuttgart, Germany

[73] Assignee: Fortuna-Werke Maschinenfabrik AG, Stuttgart, Germany

[22] Filed: Jan. 27, 1975

[21] Appl. No.: 544,673

[30] Foreign Application Priority Data

Jan. 25, 1974 Germany ..... 2403535

[52] U.S. Cl. ..... 12/127

[51] Int. Cl.[2] ..... A43D 3/00

[58] Field of Search ..... 12/127, 126, 123

[56] References Cited

UNITED STATES PATENTS

| | | | |
|---|---|---|---|
| 1,086,099 | 2/1914 | Webster | 12/127 |
| 1,319,266 | 10/1919 | Brown | 12/127 |
| 2,406,306 | 8/1946 | Morrill | 12/127 |
| 2,866,988 | 1/1959 | Rockwell | 12/127 |

*Primary Examiner*—Patrick D. Lawson
*Attorney, Agent, or Firm*—Walter Becker

[57] ABSTRACT

A device for use in the manufacture of shoes in which the shoe is mounted on a last while being machined. The last is tiltably supported near the heel end while a longitudinally adjustable tip support member supports the tip end of the last. A guide member near the tip support member guides a tool during the machining of the shoe. Adjustment of the tip support member longitudinally to adapt the machine to different lasts is accompanied by adjustment of the tip support member and the guide member respective amounts in a direction perpendicular to the longitudinal direction of the last.

10 Claims, 4 Drawing Figures

DEVICE FOR USE IN THE MANUFACTURE OF SHOES

The present invention relates to a device on a shoe making machine with which the shoes to be made are held in a supporting device which comprises a support for the tip and also comprises holding means for the heel end so that the shoes in a substantially horizontal advancing movement are passed by a machining tool which is vertically movable and is yieldably pressed against the machining surfaces of the respective shoe. More specifically, the shoes are passed by a roughening and/or pounding-on tool while on the supporting device there is arranged a guiding path on which the tool head receiving the tool will rest during a corresponding idling or starting section of the advancing movement, preferably through the intervention of a tread roller. The supporting device furthermore comprises adjusting means in order to be able in conformity with different shoe sizes to adjust the longitudinal distance between the support for the tip and the holding means for the heel end.

A device of the above mentioned type has become known in which the guiding path is vertically non-variably arranged and in which the adjustment as to height of the support for the tip has to be effected by the operation of separate handles. This adjustment is effected by the eye in such a manner that the machining tool which within the starting section is supported on the guiding path precisely engages the tip portion of the shoe sole surface to be machined. Inasmuch as the necessity of an adjustment as to height cannot always be properly recognized, and since when changing over from one shoe size to the next larger or a smaller shoe size and the operator in most instances does not carry out any adjusting strokes of less than 2mm, the outcome will be poorer machining results. There is furthermore encountered the drawback that the inclination of the shoe along its length varies with different shoe sizes because the adjustment as to height of the tip support must be rendered in conformity with the vertically non-variable guiding path. In particular, with machining automats having complicated machining tools, this effect represents a definite drawback.

It is, therefore, an object of the present invention to improve a device of the above mentioned general type in such a way that shoes can be machined or prepared at a high precision irrespective of the attention paid by the operator, and irrespective of his experience and concentration.

It is another object of this invention to improve a device of the type set forth in the preceding paragraph in such a way that when employing complicated machining tools the controlling devices therefore will be simplified.

It is still another object of this invention so to improve the heretofore known device of the above outlined type that the drawbacks of the heretofore known devices will be obviated and a more economical device will be created which is simple to manufacture and saves space.

These and other objects and advantages of the invention will appear more clearly from the following specification in connection with the accompanying drawings, in which.

The device according to the present invention is characterized primarily in that the guiding path, the support for the shoe tip and the holding means for the heel end are arranged so as to be adjustable as to height relative to each other, and is furthermore characterized in that a control device for said adjustment as to height is provided which control device is connected to the adjusting means for the distance in the longitudinal direction of the shoe between the support for the shoe tip and the holding means for the heel end.

Figure 1:
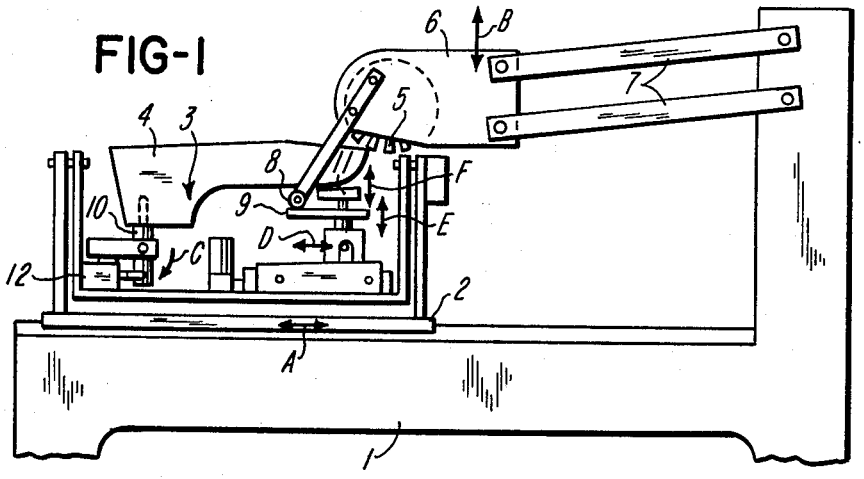
FIG. 1 is a diagrammatical simplified side view of a shoe making machine according to the invention.

Referring now to the drawings in detail and FIG. 1 thereof in particular, it will be seen that the shoe making machine as illustrated in FIG. 1 has a carriage 2 which is displaceable on a machine frame, in the direction of the arrow A for the advancing movement on a machine frame 1. The shoe making machine furthermore comprises a supporting device generally designated 3 which is arranged on said carriage 2 and is intended for a shoe 4 to be machined or processed thereon. The carriage 2 with the supporting device 3 is by means of a non-illustrated advancing drive moved forwardly and rearwardly whereby the shoe 4 is passed by and below a machining tool 5. The tool head 6 which receives the tool 5 is by means of a parallelogram drive 7 linked to the machine frame, and is freely movable in vertical direction according to the arrow B. During the idling and/or starting of the advancing movement, the tool head 6 rests through the intervention of a roller 8 on a guiding path 9.

The supporting device 3 comprises primarily a heel mandrel 10 upon which the shoe to be made or the last carrying said shoe is placed, and furthermore comprises a tip support 11. By means of an electromagnet 2 the heel mandrel 10 is pivoted in the direction of the arrow C whereby the tip of the shoe is pressed onto the tip support 11 and the heel mandrel 10 is canted or tilted in the last bore 13. The shoe to be prepared is in this way firmly clamped in. For purposes of clamping in shoes of different sizes, the longitudinal distance between the heel mandrel and the tip support has to be varied as indicated by the arrow D. As indicated by the arrows E, F, a change in the longitudinal distance automatically brings about an adjustment as to height of the guiding path 9 and the tip support 11.

Figure 2:
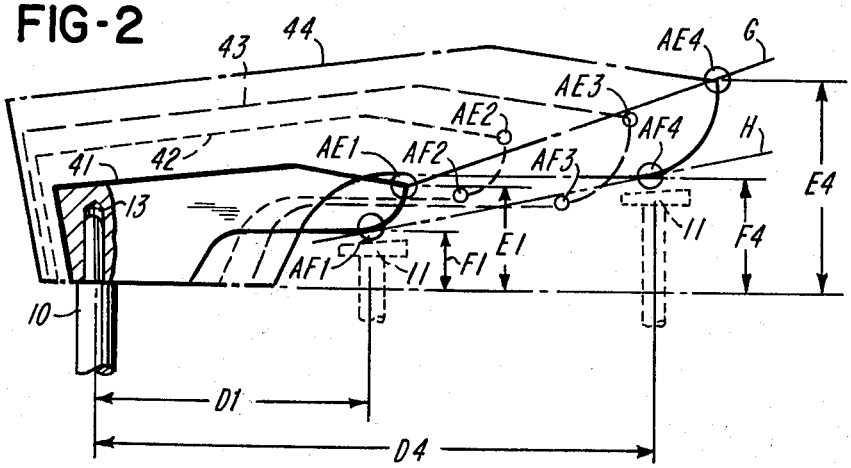
FIG. 2 shows a diagrammatic illustration of different shoe sizes.

The connection between the individual adjusting methods will become evident from the diagrammatic illustration in FIG. 2. FIG. 2 shows successive shoe sizes 41, 42, 43 and 44. The position of last bore 13 and heel mandrel 11 is in this instance assumed as to be a non-variable reference position. There may now be explained the employed terms and designations. The designations AE1 and AE4 designate on shoes 41 and 44 the starting point for the machining from which the machining tool is intended to contact the shoe. The distance between the machining tool 5 and the roller 8 determines the spatial or relative arrangement of the guiding path relative to the respective starting points AE1 and AE4. The horizontal longitudinal distance between the tip support and the heel mandrel is designated with the shoe size 41 by D1 and with the shoe size 44 by D4. In conformity with the two extreme sizes, there is also shown the different separations of the rows according to F1 and F4. By automatically adapting the tip support to these different separations it will be assured that all shoe sizes will be clamped in with approximately the same longitudinal inclination. By means of the automatic height adjustment of the guiding path 9 in conformity with the heights E1 and E4, it will be assured that the machining tool will always first touch the shoe at the starting points AE1 and AE4. A straight connecting line G connects the two starting points AE1 and AE4, and a straight connecting line H is drawn through the two engaging points AF1 and AF4. In FIG. 2 there are for instance indicated intermediate sizes corresponding to the shoes 42 and 43, which do not fit linearly into the size ratio of the shoes 41 and 44. Consequently, the points AE2 and AE3 will lie outside the connecting line G, and the points AF2 and AF3 will be located outside the straight connecting line H. This relationship will be further discussed below.

According to a preferred embodiment of the invention, the control device for the adjustment as to height of the tip support and of the guiding path is divided into two control units. The first control unit affects the relative height adjustment between the heel mandrel and the tip support, whereas the second control unit controls the relative height adjustment between the heel mandrel and the guiding path.

Tests have shown that with the presently customary shoe designs it is advantageous to design the second control unit with a greater transmission ratio than the first control unit.

It has proved particularly advantageous to design the control units as a thrust cam drive (Schubkurventriebe) in which instance the respective transmission ratio can be predetermined by exchangeable thrust cams. In this way it will be possible in a simple manner to obtain an adaptation to different shoe designs. By correspondingly designing the cams, the above mentioned deviations of linearity can be taken into consideration.

Figure 3:
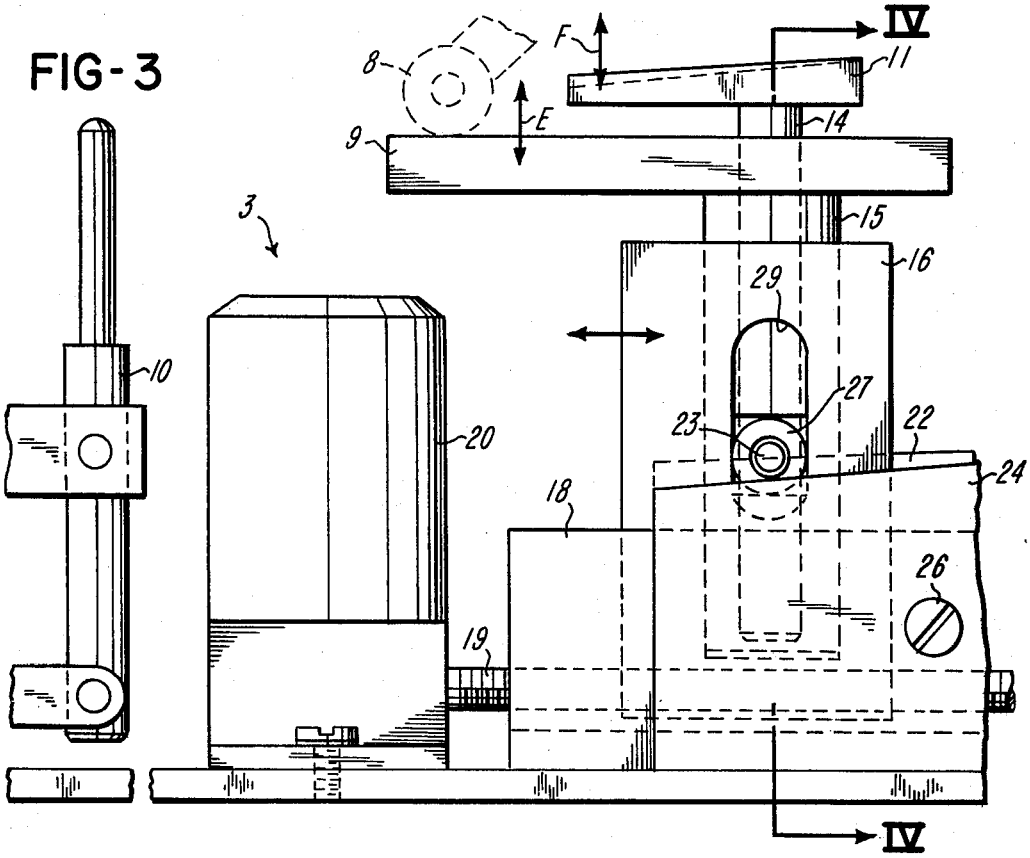
FIG. 3 is a side view of the present invention.
Figure 4:
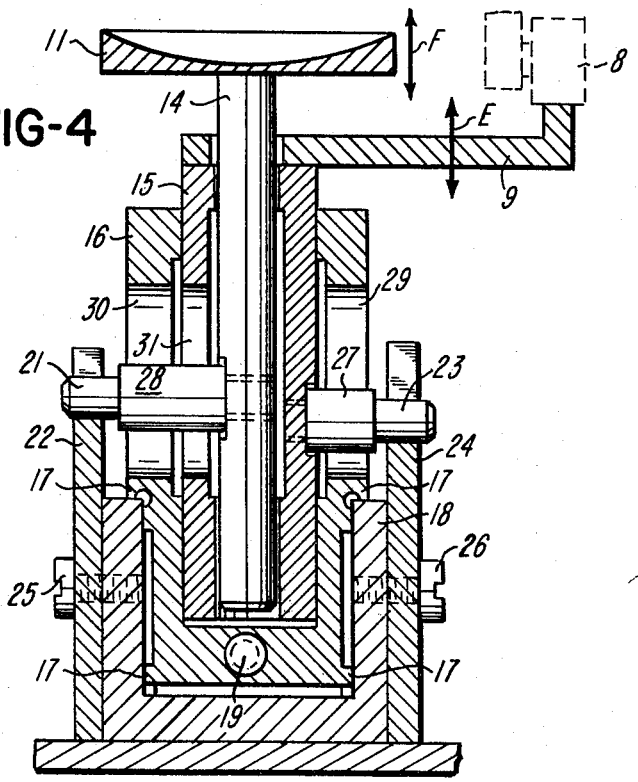
FIG. 4 is a section taken along the line IV—IV of FIG. 3.

A device according to the preferred embodiment of the invention is shown in detail in FIGS. 3 and 4. In these figures, those elements which correspond to elements of FIG. 1 have been designated with the same reference numerals as in FIG. 1. The tip support 11 is connected to a shank 14, and the guiding path 9 is connected to a sleeve 15 in which said shank 14 is vertically slideable but is non-rotatably mounted. The sleeve 15 itself is vertically slideable but is non-rotatably mounted in a supporting body 16 which in adaptation to different shoe sizes is adapted to be displaced in horizontal longitudinal direction. To this end the supporting body 16 has sliding guiding means 17 by means of which the supporting body 16 is seated on a slide part 18. For purposes of longitudinally placing, in this instance for instance a threaded spindle 19 is employed which is coupled to the adjusting means for the longitudinal distance between the tip support and the heel mandrel. According to a further development of the invention, these adjusting means have a particularly programmed controllable step motor 20 whereby also this adjustment can be effected fully automatically and consequently will no longer depend on the attention and the skill of the operator.

Due to the fact that the shank 14 and sleeve 15 are arranged one within the other in a coaxial manner, a compact construction is obtained which can easily be realized which fact represents a further important advantage.

Principally, within the framework of the present invention the vertical drive of the sleeve 15 and the shank 14 may also be effected in another manner than will now be described. An advantageous simple further development of the invention is characterized in that a first thrust roll 21 is connected to shank 14 which roll engages a thrust cam 22. Connected to the sleeve 15 is a second thrust roll 23 which engages a second thrust cam 24. The two cams 22 and 24 are by means of screws 25 and 26 laterally connected to the slide path 18 and, if needed, may be exchanged for other thrust cams. Roller bodies 27 and 28 extend through slot-like recesses 29, 30 and 31 and thus prevent a turning of shank 14 and sleeve 15. The rollers 21 and 23 may be rotatably or fixedly received in the roller bodies 27 and 28. A fixed arrangement of rollers 21 and 23 in roller bodies 27 and 28 corresponds to the simplified illustration in FIG. 4.

By longitudinally displacing the supporting body 16 in the direction D, the rollers 21 and 23 are adjusted in horizontal direction relative to the cams 22 and 24. The above described and illustrated embodiment of the invention is based on the finding that the heel mandrel which was illustrated as symbolizing other possible holding means on the heel side can be considered as the proper non-variable reference point. It is, however, within the framework of the present invention if for instance the guiding path is vertically non-variable and correspondingly the tip support and the heel mandrel are vertically variable. It is, however, necessary that the guiding path, the tip support, and the holding means on the heel side are adjustable as to height relative to each other.

As will be evident from the above, the advantage of the device according to the invention consists primarily in that the height adjustment of the tip support can in order to maintain all shoe sizes at at least approximately the same longitudinal inclination, be effected so that control operations by more complicated machining tools will not require any correction as to the longitudinal inclination. The relative height adjustment between the guiding path, the tip support, and the holding means on the heel side is effected automatically with the change in the longitudinal distance between the tip support and the holding means on the heel side so that no additional time consuming and skilled individual operations are necessary.

It is, of course, to be understood that the present invention is, by no means, limited to the specific showing in the drawings but also comprises any modifications within the scope of the appended claims.

What is claimed is:

1. In a device for use in manufacture of shoes; a frame, support element in the frame engageable with the heel end of a last in inserted position of the last, a support member in the frame for engagement with the tip end of the last, a tool in the frame operatively engageable with a shoe on the last, a guide member in the frame adjacent said support member operable for guiding said tool as the tool traverses the shoe in the longitudinal direction, means for adjusting said support element and support member together with said guide member relatively in said frame in the longitudinal direction of the last to adapt the device to lasts of different sizes, and control means responsive to movement of said support element and said support member together with said guide member relatively in the longitudinal direction for adjusting said support element and said support member and said guide member relatively in a direction perpendicular to said longitudinal direction, the adjustment of said guide member relative to said support element by said control means being greater than the adjustment of said support member relative to said support element by said control means.

2. In a device for use in the manufacture of shoes; a frame, support element in the frame engageable with the heel end of a last in inserted position of the last, a support member in the frame for engagement with the tip end of the last, a tool in the frame operatively engageable with a shoe on the last, a guide member in the frame adjacent said support member operable for guiding said tool as the tool traverses the shoe in the longitudinal direction, means for adjusting said support element and support member together with said guide member relatively in said frame in the longitudinal direction of the last to adapt the device to lasts of different sizes, and control means responsive to movement of said support element and said support member together with said guide member relatively in the longitudinal direction for adjusting said support element and said support member and said guide member relatively in a direction perpendicular to said longitudinal direction, said control means comprising a pair of cams having inclined cam surfaces thereon, a follower connected to each of said support member and guide member and engaging a respective cam surface, and means for moving said cams and followers relatively during adjustment of said support element and said support member together with said guide member relatively in the longitudinal direction of the last.

3. A device according to claim 2 which includes a shank supporting said support member, a sleeve surrounding the shank and supporting said guide member, a tubular member surrounding said sleeve, said cams being disposed on opposite sides of said sleeve and having the cam surfaces thereof on top, said followers projecting laterally through respective axial slots in the sleeve into engagement with said cam surfaces of said cams, said control means when actuated moving said cams and tubular member relatively in the longitudinal direction.

4. A device according to claim 1 in which the follower on said shank is slidable on an axial slot formed in said sleeve.

5. A device according to claim 1 in which said followers include rollers which engage said cam surfaces.

6. A device according to claim 1 in which said support element and cams are nonmovable on said frame in the longitudinal direction and said control means moves said shank and sleeve in the longitudinal direction when said control means is actuated.

7. A device according to claim 1 in which said control means comprises a step motor and a longitudinal screw driven thereby and threadedly connected to said tubular member.

8. A device according to claim 1 in which said support element is tiltable in the frame for pressing a last thereon downwardly into engagement with the support member at the tip end of the last.

9. A device according to claim 1 in which said guide member has a generally horizontal upper surface and said tool is mounted on a support movable in said frame and having a roller resting on said upper surface of the guide member.

10. A device according to claim 2 in which the relative adjustments of said support tip and of said guide member relative to said support element as effected by said control means are different.

* * * * *